US008998107B2

(12) United States Patent
Sesser et al.

(10) Patent No.: US 8,998,107 B2
(45) Date of Patent: Apr. 7, 2015

(54) POP-UP SPRINKLER WITH INTEGRATED PRESSURE REGULATOR AND DRAIN CHECK

(75) Inventors: George L. Sesser, Walla Walla, WA (US); Craig B. Nelson, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 996 days.

(21) Appl. No.: 12/461,105

(22) Filed: Jul. 31, 2009

(65) Prior Publication Data

US 2011/0024523 A1 Feb. 3, 2011

(51) Int. Cl.
*B05B 15/10* (2006.01)
*B05B 1/30* (2006.01)

(52) U.S. Cl.
CPC ..... *B05B 15/10* (2013.01); *B05B 1/3006* (2013.01); *B05B 1/3033* (2013.01)

(58) Field of Classification Search
CPC ..... B05B 15/10; B05B 1/3006; B05B 1/3033
USPC ..... 239/200–208, 231, 237, 252, 256, 239/261–264
See application file for complete search history.

(56) References Cited

U.S. PATENT DOCUMENTS 675,854 A 6/1901 Emery
1,999,470 A * 4/1935 Munz ..... 239/230
3,117,724 A * 1/1964 Ray ..... 239/97
3,323,725 A 6/1967 Hruby, Jr.
4,479,611 A 10/1984 Galvis
4,729,511 A * 3/1988 Citron ..... 239/205
4,913,352 A 4/1990 Witty et al.
4,971,250 A * 11/1990 Hunter ..... 239/222.17
5,415,130 A * 5/1995 Brackett ..... 119/670
5,779,148 A 7/1998 Saarem et al.
6,186,413 B1 * 2/2001 Lawson ..... 239/205
6,481,644 B1 * 11/2002 Olsen ..... 239/456
6,491,235 B1 12/2002 Scott et al.
6,739,527 B1 * 5/2004 Chung ..... 239/558
6,997,393 B1 2/2006 Angold et al.
2008/0164341 A1 * 7/2008 Katzman et al. ..... 239/205
2008/0308650 A1 * 12/2008 Clark ..... 239/204
2009/0072048 A1 * 3/2009 Renquist et al. ..... 239/242

* cited by examiner

*Primary Examiner* — Len Tran
*Assistant Examiner* — Joel Zhou
(74) *Attorney, Agent, or Firm* — Nixon & Vanderhye P.C.

(57) ABSTRACT

A sprinkler head includes a first housing carrying a center stem having an inlet at an upstream end and an outlet at a downstream end. A second housing is supported within the first housing and encloses a nozzle and a pressure regulator in axially-aligned relationship, defining a flowpath between the inlet and an orifice of the nozzle. The second housing is normally biased to a retracted position but is moveable to an extended position relative to the first housing and to the center stem. A surface of the pressure regulator cooperates with the outlet of the center stem as the second housing moves relative to the first housing to regulate pressure to the nozzle orifice.

22 Claims, 7 Drawing Sheets

POP-UP SPRINKLER WITH INTEGRATED PRESSURE REGULATOR AND DRAIN CHECK

This invention relates to sprinkler heads, and more specifically, to an extendable, retractable sprinkler head incorporating pressure regulation, self-clean and drain check functions.

BACKGROUND OF THE INVENTION

Sprinkler heads adapted for mounting to fixed risers are well known in the art. Such sprinkler heads, however, are prone to clogging due to debris that may collect in or around the nozzle, particularly during extended periods of nonuse. Above-ground sprinklers are also susceptible to damage from any number of sources due to close proximity to, for example, human traffic, agricultural machines and the like. In addition, typical sprinkler heads do not accommodate changes in line pressure, thereby producing uneven sprinkling patterns.

There remains a need for an above-ground sprinkler head that is substantially sheltered during periods of nonuse, that is easy to clean (particularly in the nozzle area), and that automatically accommodates line pressure changes.

BRIEF DESCRIPTION OF THE INVENTION

In the exemplary but nonlimiting implementations of the invention disclosed herein, an extendable, retractable sprinkler head is provided that is especially useful when mounted above ground on fixed risers (typically, a few inches to about 15 feet above the ground, depending on application). The sprinkler head incorporates an extendable nozzle and water-distribution (or rotor) plate assembly that is normally biased to a retracted position where the nozzle and rotor plate are substantially enclosed. Upon the introduction of water under pressure to the sprinkler head, the line pressure overcomes the normal bias, moving the nozzle and water-distribution plate assembly upward to an extended position. In this way, the critical components of the sprinkler head are enclosed and thus sheltered during periods of nonuse.

A built-in pressure regulator device compensates for line pressure changes, and a built-in drain check prevents any back flow when the nozzle and water-distribution plate assembly moves to the retracted position.

Another feature relates to a controlled rotational speed of the nozzle and water-distribution plate by means of a viscous damping arrangement.

Still another feature relates to the use of a fixed nozzle cleaning pin shaped and arranged to automatically clear the nozzle upon retraction of the nozzle and water-distribution plate.

Accordingly, in one aspect, the invention relates to a sprinkler head comprising: a first housing carrying a center stem having an inlet at an upstream end and an outlet at a downstream end; a second housing supported within said first housing and enclosing a nozzle and a pressure regulator in axially-aligned relationship defining a flowpath between said inlet and an orifice of said nozzle, said second housing normally biased to a retracted position but moveable to an extended position relative to said first housing and to said center stem, wherein a surface of said pressure regulator cooperates with said outlet of said center stem as said second housing moves relative to said first housing to regulate pressure to said nozzle orifice.

In another aspect, the invention relates to a sprinkler head comprising: a first outer housing adapted to attachment to a riser; a second inner housing normally enclosed in a retracted position within the first outer housing and moveable to an extended operative position; the second housing supporting a nozzle and a rotatable water-distribution plate downstream of the nozzle; the second housing further including first means for continuously regulating pressure of water delivered to the nozzle, second means for controlling speed of rotation of the water-distribution plate, and third means for automatically cleaning the nozzle upon movement of the second housing to the retracted position.

In still another aspect, the invention relates to a sprinkler head comprising: a first housing carrying a center stem having an inlet at an upstream end and an outlet at a downstream end;

a second housing supported within said first housing and enclosing a nozzle having a nozzle orifice;

said second housing normally biased to a retracted position but moveable to an extended position relative to said first housing and to said center stem;

a pin fixed to said center stem and extending upwardly through said nozzle orifice in said retracted position but spaced from said nozzle orifice when said second housing is in said extended position, such that said nozzle orifice is automatically cleaned upon movement of said second housing from said extended position to said retracted position.

The invention will now be described in detail in connection with the drawings identified below:

DETAILED DESCRIPTION OF THE INVENTION

Figure 1:
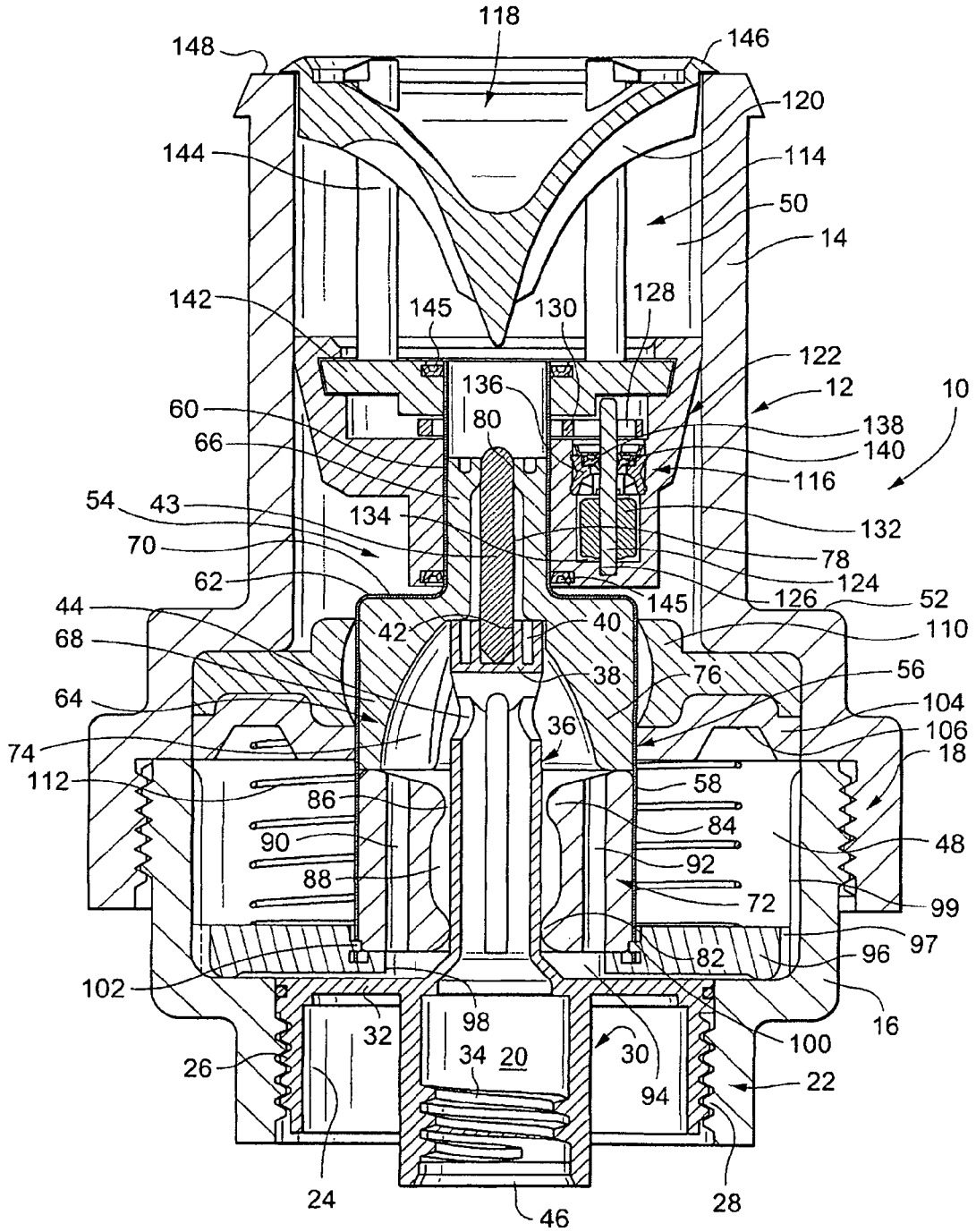
FIG. 1 is a cross section through a sprinkler head in accordance with a first exemplary but nonlimiting embodiment of the invention.

Referring initially to FIG. 1, the pop-up sprinkler head 10 is comprised of a housing 12 which includes an upper cylindrical housing portion 14 and a lower cylindrical housing portion 16, assembled at a threaded joint 18. A fixed stem 20 (also referred to herein as a "center stem") is attached to the lower housing portion 16 at a second threaded joint 22, the stem extending upwardly into the housing 12 along a vertical center axis of the sprinkler head.

Figure 2:
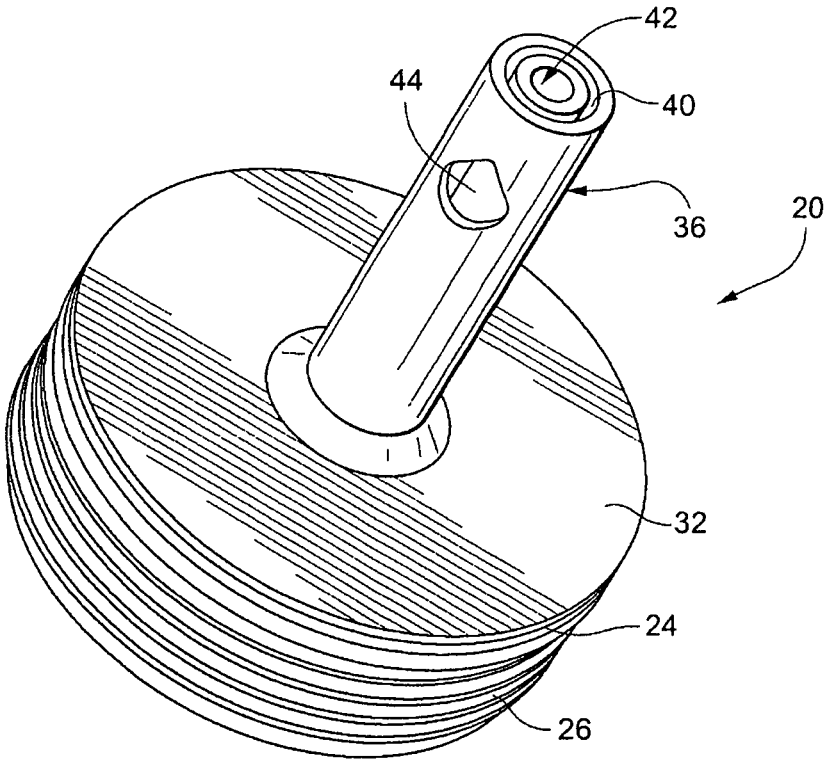
FIG. 2 is a perspective view of a center stem component removed from the sprinkler head shown in FIG. 1.
Figure 3:
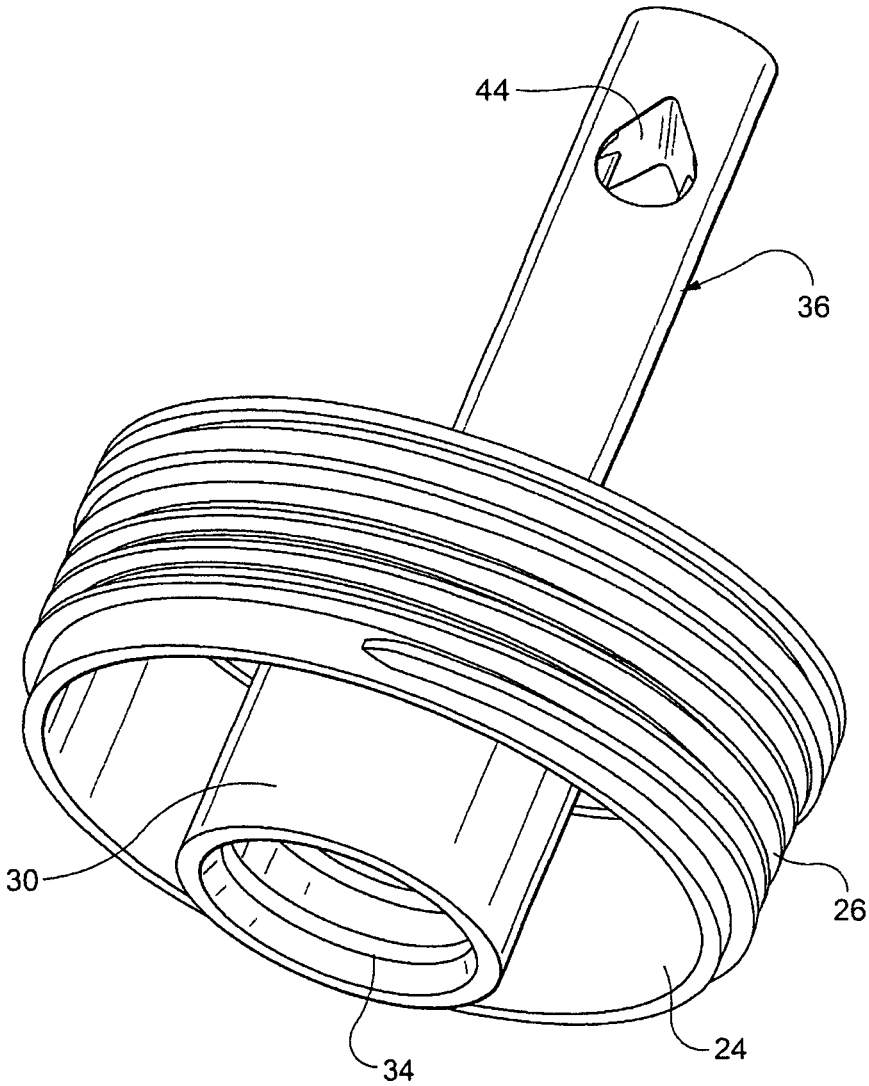
FIG. 3 is another perspective view of the center stem component shown in FIG. 2.

More specifically, and with further reference to FIGS. 2 and 3, the center stem 20 is formed with a lower, relatively larger diameter skirt 24 provided with external threads 26 that engage internal threads 28 on the lower housing portion 16. The skirt 24 is connected to a relatively smaller diameter adapter 30 by an annular ring-shaped wall 32. The adapter 30 is formed with internal threads 34 by which the sprinkler head 10 may be attached to an above-ground supply conduit or riser (not shown). In that regard, it will be appreciated that other connection mechanisms may be employed, such as quick connect/disconnect couplers. A center stem portion 36 extends upwardly from the wall 32, terminating at a closed upper end defined by a top wall 38 formed with an upwardly open, outer blind bore 40 and concentrically-arranged inner blind bore 42 supporting a nozzle-cleaning pin 43 described further below.

Adjacent and below the top wall 38, the center stem portion 36 is provided with one or more circumferentially-spaced, teardrop-shaped apertures 44. As will be explained in greater detail below, water under pressure will flow into the center stem 20 via an inlet 46 and exit the apertures 44.

Returning to FIG. 1, the upper and lower housing portions 14, 16 are configured to form two chambers, a lower chamber 48 and an upper chamber 50. The lower chamber 48 has a relatively larger diameter than the upper chamber 50, as determined by the annular shoulder 52 at the lower end of the upper housing portion 14 that joins the upper and lower housing portions 14, 16. The chambers 48, 50 are sealed from each other as described further herein.

Surrounding the center stem 20, and extending axially within both chambers 48 and 50, is an extendable and retractable nozzle and pressure regulator (NPR) assembly 54 supported in a manner that enables the pop-up feature of the sprinkler head.

The NPR assembly 54 includes a generally cylindrical, preferably metal (e.g., stainless steel) nozzle housing 56 having a relatively larger-diameter lower portion 58 and a relatively smaller-diameter upper portion 60, joined by an annular shoulder 62. A nozzle (or nozzle insert) 64 formed with mated upper and lower sections 66, 68, respectively, joined at an annular shoulder 70, thus permitting the nozzle 64 to be mated to the housing 56. The nozzle 64 may be made of an elastomeric, tear-resistant material (e.g., polyurethane) or other suitable material. Upstream of the nozzle 64 is a pressure regulator 72 having a uniform outer diameter (or OD) engaged with the inner surface of the lower nozzle housing portion 58, and engaged at its upper end with the lower edge of the nozzle 64.

Figure 4:
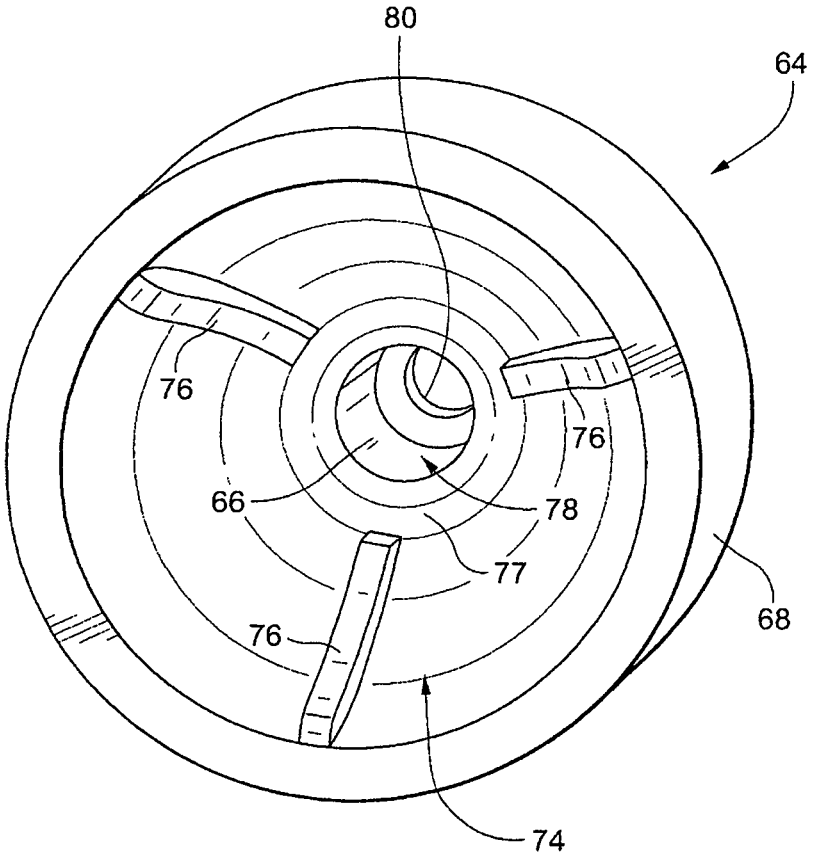
FIG. 4 is a perspective view of a nozzle insert removed from the sprinkler head of FIG. 1.

The nozzle 64 has a generally dome-shaped inner chamber 74 in the lower nozzle section 68, formed with a series of inner ribs 76, best seen in FIG. 4, that, along with annular surface 77, engage and seal against the upper edge of stem 36 as shown in FIG. 1 when the NPR assembly 54 is retracted to the position shown in FIG. 1. A smaller-diameter inner bore 78 extends upwardly from the chamber 74 to a nozzle orifice 80.

The pressure regulator 72 has a nonuniform inner diameter (or ID), including a first upstream (lower) end 82 adapted to engage and seal against the OD of the center stem portion 36, and an upper end 84 designed to have a clearance or gap 86 between the upper end 84 and the center stem portion 36. Between the upper and lower ends 84, 82 there is an annular recess 88.

The pressure regulator 72 is also formed with a plurality (at least two) of axially extending bores 90, 92 communicating between the nozzle inner chamber 74 and an annular space 94 below the pressure regulator 72.

Figure 6:
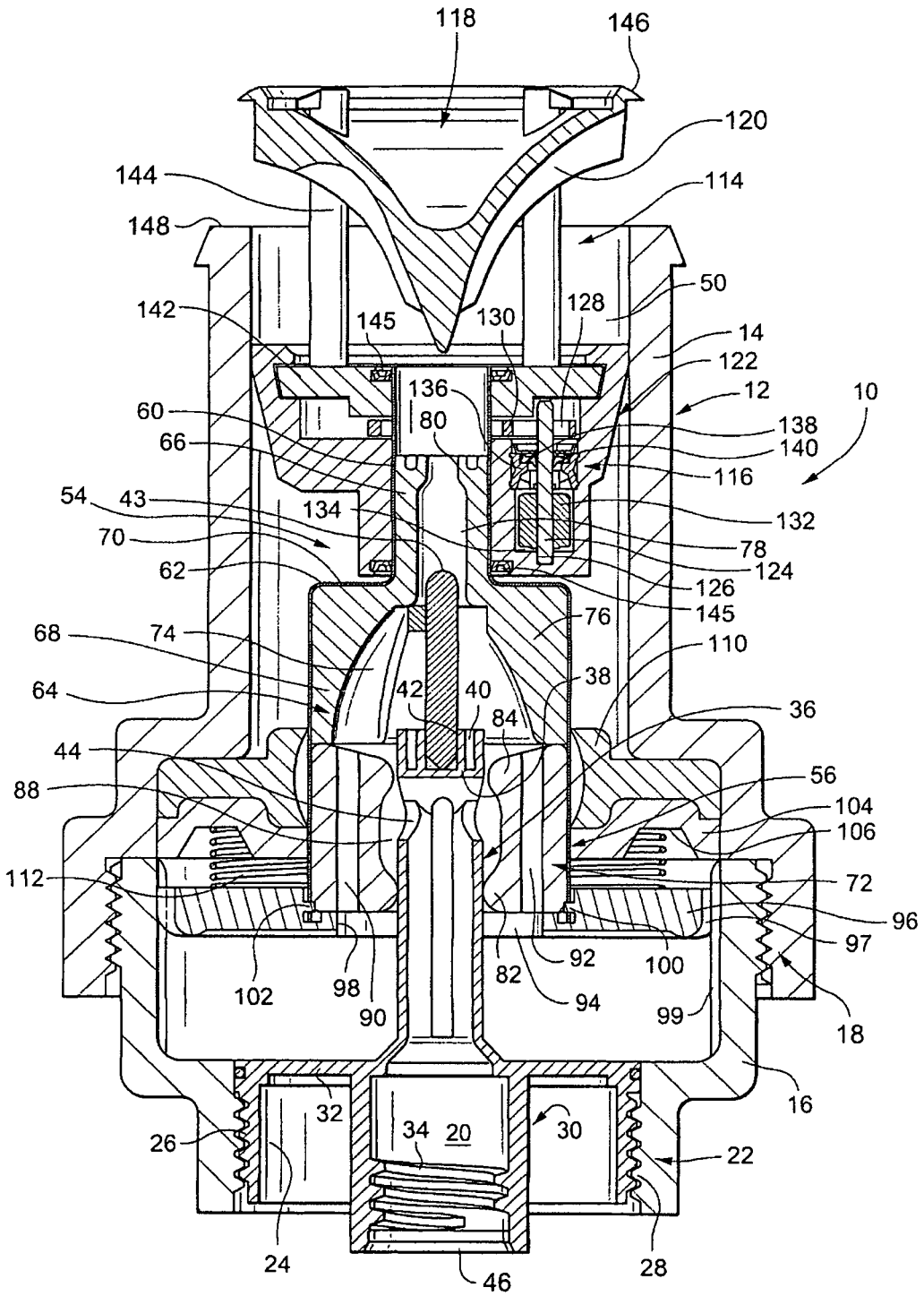
FIG. 6 is a cross section similar to FIG. 1 but with the sprinkler nozzle and water-distribution plate shown in an extended position.

An annular lower spring plate 96 with a center opening 98 is attached to the bottom of the nozzle housing 56 via a series of recesses 100 in the pressure regulator 72 that receive a like plurality of radially extending pins 102 in the plate 96 (see FIG. 6). The OD of the lower spring plate 96 is formed with a plurality of ribs or flutes 97 that mesh with vertical ribs 99 formed on the inner wall of the lower housing portion 16. This interengagement prevents the plate 96 from rotating during extension and retraction of the NPR assembly 54 as described below.

Separating the upper and lower chambers 50, 48 is an upper spring plate 104 formed with a downwardly concave, annular groove 106. A double-lip seal 110 is interposed between the upper spring plate 104 and the underside of the annular shoulder 52 of the upper housing portion 14. A coil spring 112 is interposed between the upper and lower spring plates 104, 96 with the upper end of the spring 112 engaged within the groove 106. The double-lip seal 110 engages the nozzle housing 56 so as to seal the chamber 48 from the chamber 50, and thus also prevent debris from entering the lower chamber 48.

Figure 5:
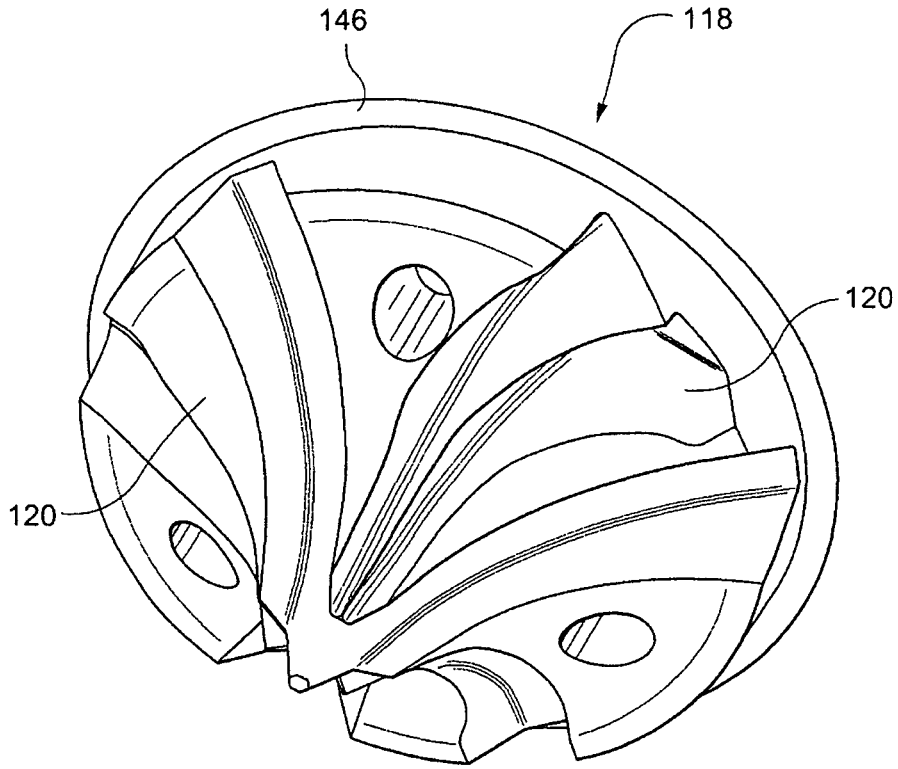
FIG. 5 is a perspective view of a water-distribution plate removed from the sprinkler head of FIG. 1.

Supported on the upper end of the nozzle housing 56 (and thus also a part of the NPR assembly 54) is the water-distribution plate assembly 114 which includes a brake housing assembly 116 that controls the rotational speed of a replaceable rotor or water-distribution plate 118. The water-distribution plate 118, best seen in FIG. 5, is of conventional design, having a series of grooves 120 that are curved in a circumferential direction to impart rotation to the plate when impinged upon by a stream of water emitted from the nozzle orifice 80.

The brake housing assembly 116 includes a brake housing 122 telescoped over the upper end of the nozzle housing 56 and rotatable relative to the nozzle housing. Within the brake housing, there is an offset viscous brake "motor" including a rotatable shaft 124 (extending parallel to the center axis of the sprinkler head) having a lower end received in a bearing recess 126 formed in the lower end of the brake housing, and an upper end which mounts a first gear 128 engaged with a second gear 130 fixed to the nozzle housing. The shaft 124 also mounts a rotor 132 (plastic or metal) adjacent the lower end of the shaft, the rotor located within a chamber 134 closed at its upper end by a shaft bearing 136 and sealed by a double-lip seal 138, the latter held in place by a retainer 140. The chamber 134 is filled or partially filled with a viscous fluid such as silicone or the like. The rotational speed of the water-distribution plate 118 will thus be controlled by the geared arrangement between the water-distribution assembly 114 and the rotationally fixed nozzle housing 56, and specifically by the viscous shear effect between the rotor 132 and the viscous fluid in the chamber 134. The viscous brake effectively slows the rotation of the water-distribution plate 118 so that the integrity of the streams thrown off the rotor plate is enhanced, thereby increasing the radius of throw of those streams. It will be appreciated that different gear configurations may be utilized to produce non-circular patterns or random hesitation, the latter providing a more uniform sprinkling pattern.

A cap or cover 142 is snapped into place over the top of the brake housing 122, and two or more (preferably three) struts 144 extend upwardly from the cap 142 to support the water-distribution plate 118 in axially aligned relationship with the nozzle orifice.

A pair of grease seals 145 is employed in the brake housing assembly 116 and cap 142 to facilitate rotation of the brake housing 122 relative to the nozzle housing 56 and to prevent water (or other debris, such as sand particles) from passing between the brake housing assembly 116 and the nozzle housing 56.

In the retracted position shown in FIG. 1, the NPR assembly 54, including the rotor or water-distribution plate 118 is enclosed within the upper housing 14, with a radial flange 146 on the water-distribution plate engaged with the upper edge 148 of the upper housing portion. This is the default or normal bias position of the water-distribution plate 118, as determined by the downward bias of the coil spring 112 on the lower spring plate 96.

When water under pressure is supplied to the sprinkler head 10, the water will flow through the center stem portion 36 via inlet 46 and into the nozzle housing 56 via the teardrop-shaped apertures 44, and then to the water-distribution plate 118. Some water will also flow through the bores 90, 92 and exert an upward force on the pressure regulator 72. As the upward pressure generated by the water line pressure overcomes the downward bias of the spring 112, the NPR assembly 54 will begin to rise to the extended position shown in FIG. 6.

With further reference to FIG. 6, note that the upper, radially inwardly facing, and convexly curved annular end portion 84 of the pressure regulator 72 will move along the teardrop-shaped apertures 44 and thus restrict flow through those apertures, seeking an equilibrium position where the upward force created by the line pressure of the water and the downward force exerted by the coil spring 112, are equal. As line pressure increases, the NPR assembly 54 moves upwardly, but the amount of restriction increases (due to the teardrop shape of apertures 44, noting that the aperture area decreases in an upward direction), and thus the upward force decreases, allowing the spring pressure to push downwardly, again seeking equilibrium. Similarly, if the line pressure decreases, the spring 112 will push the NPR assembly 54 downwardly, thus lessening the flow restriction and increasing flow to counter the spring action. It will be understood that the spring constant of the spring 112 is calibrated or matched to the nominal line pressure so that the continuously sought equilibrium position produces the desired output.

When the water or line pressure is cut off, the spring 112 will return the NPR assembly 54 to the retracted position shown in FIG. 1. During retraction, the nozzle cleaning pin 43 pushes through the nozzle orifice 80, thereby clearing the nozzle of any debris. Note that the choice of an elastomeric material for the nozzle is significant in that debris being cleared by the pin 43 will not damage the nozzle. When in the extended or operable position (FIG. 6), the NPR assembly 54 is moved upwardly away from the fixed cleaning pin 43, thus permitting unobstructed flow through the nozzle orifice 80. It will also be appreciated that in the extended position, the NPR assembly 54 may be pushed downwardly manually, and then released, resulting in a quick but effective flush of the nozzle without having to shut the system down.

When the NPR assembly 54 is returned to the retracted position, the ribs 76 and annular surface 77 of the nozzle will seal against the upper edge of the center stem 36, thereby providing the drain check function, in that water is prevented from flowing in either direction, i.e., to or from the nozzle chamber 74.

Nozzle orifice sizes may vary depending on requirements, and the pin 43 may or may not need replacement with a nozzle change. For example, if the nozzle orifice were made smaller than the pin OD, then the pin would also need to be changed. If, however, the nozzle orifice were made larger, the pin may not need replacement since it would still be effective to clear the nozzle orifice of debris.

Figure 7:
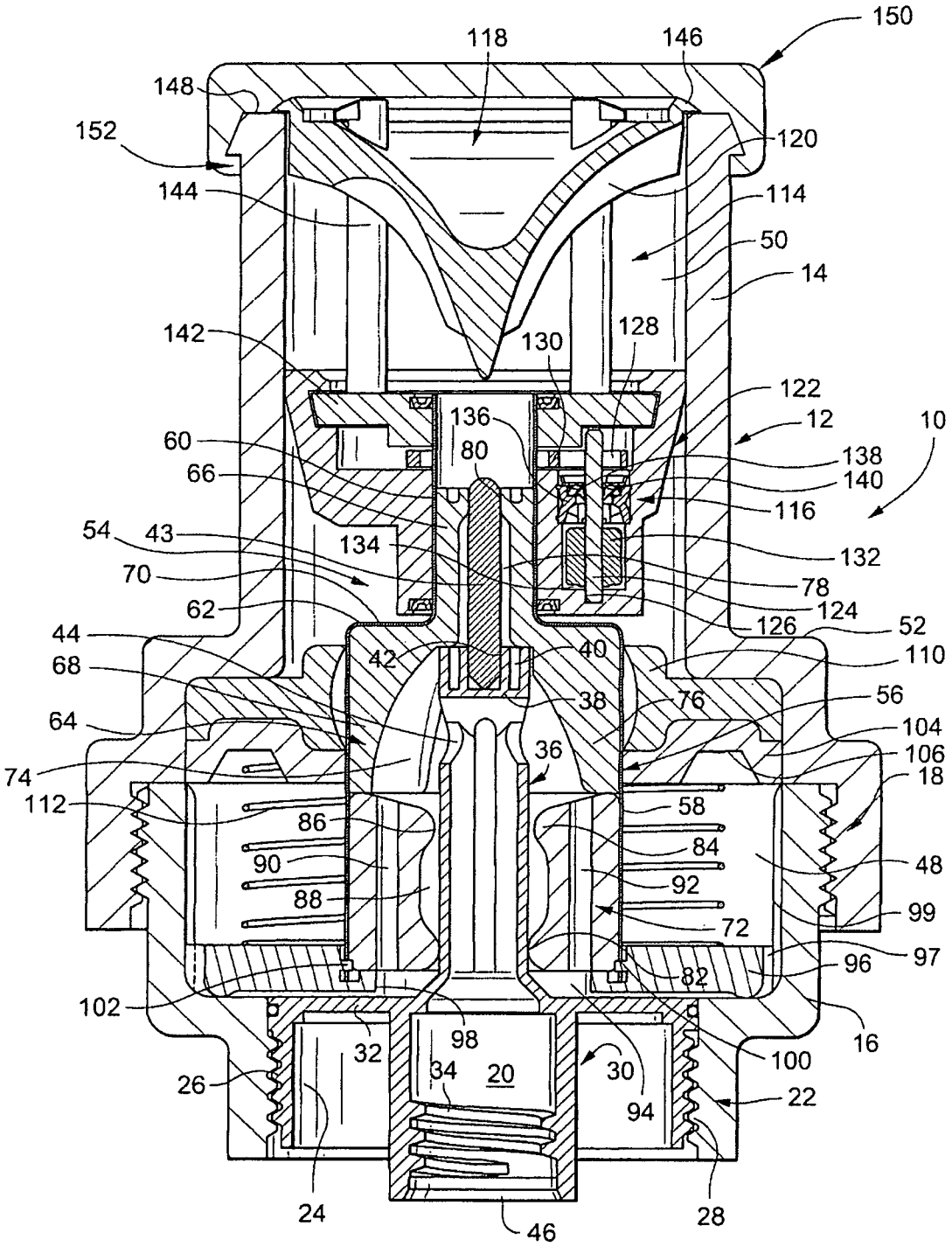
FIG. 7 is a cross section similar to FIG. 1 but showing an optional cap applied to the sprinkler head.

FIG. 7 illustrates an optional feature relating to the use of a cap 150 that may be affixed to the top of the sprinkler head 10. The snap-over (or other substantial equivalent such as bayonet fit or screw thread) fastening arrangement 152 is sufficiently strong to keep the NPR assembly 54 in the retracted position even under line pressure. Thus, any one or more sprinkler heads 10 in an array of heads may be kept closed even when subjected to line pressure, depending on desired watering sequence, patterns and other factors.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler head comprising:

a first housing carrying a center stem having an inlet at an upstream end and a radially outwardly-facing outlet aperture at a downstream end;

a second housing supported within said first housing and enclosing a nozzle provided with a nozzle orifice and a pressure regulator in axially-aligned relationship defining a flowpath between said inlet and an orifice of said nozzle, said second housing normally biased to a retracted position by a spring but moveable to an extended position relative to said first housing and to said center stem by a line pressure of fluid in said center stem, wherein a surface of said pressure regulator moves relative to said outlet aperture of said center stem to change the size of the flowpath through said outlet aperture as said second housing moves relative to said first housing such that a force created by the line pressure and a force exerted by the spring are equal to regulate pressure to said nozzle orifice.

2. The sprinkler head of claim 1 wherein said radially outwardly-facing outlet aperture of said center stem comprises at least one teardrop-shaped aperture, and wherein said surface of said pressure regulator comprises a radially-inwardly facing convexly-curved surface.

3. The sprinkler head of claim 1 wherein said second housing supports a water-distribution plate downstream of said nozzle orifice, said water-distribution plate formed with grooves configured to cause said water-distribution plate to rotate relative to said first and second housings when a stream of water emitted from said nozzle orifice impinges on said grooves.

4. The sprinkler head of claim 3 wherein, in said retracted position, said second housing and said water-distribution plate are enclosed within said first housing.

5. The sprinkler head of claim 3 and further comprising a brake housing supported on an upper portion of said second housing, with said water-distribution plate mounted on said brake housing, said brake housing rotatable along with said water-distribution plate, relative to said first and second housings.

6. The sprinkler head of claim 5 wherein said brake housing incorporates a viscous brake operatively connected to said water-distribution plate, said viscous brake comprising a rotatable element and non-rotatable element cooperating with a viscous fluid to slow rotation of said water-distribution plate.

7. The sprinkler plate of claim 5 wherein said brake housing carries a shaft rotatable with said brake housing, said shaft carrying a first gear engaged with a second gear carried by said second housing, said shaft also carrying a rotor element located within a chamber at least partially filled with a viscous fluid such that rotation of said shaft and said first gear, along with rotation of said brake housing and water-distribution plate, are slowed by shearing of said viscous fluid between said rotor element and a wall of said chamber.

8. The sprinkler head of claim 2 wherein said first housing is divided into upper and lower chambers separated by a fixed annular seal and a fixed upper spring plate; said second housing mounting a lower spring plate at a lower end thereof for axial movement with said second housing; and said spring interposed between said upper and lower spring plates for normally biasing said second housing to said retracted position.

9. The sprinkler head of claim 8 wherein said pressure regulator is provided with at least one passageway establishing fluid communication between an internal chamber of said nozzle and an area below said pressure regulator, such that upon introduction of fluid under pressure to said nozzle, a portion of the fluid will flow into said area below said pressure regulator, causing said second housing and said water-distribution plate to move to said extended position.

10. A sprinkler head comprising:

a first housing carrying a center stem having an inlet at an upstream end and an outlet at a downstream end;

a second housing supported within said first housing and enclosing a nozzle and a pressure regulator in axially-aligned relationship defining a flowpath between said inlet and an orifice of said nozzle, said second housing normally biased to a retracted position but moveable to an extended position relative to said first housing and to said center stem, wherein a surface of said pressure regulator cooperates with said outlet of said center stem as said second housing moves relative to said first housing to regulate pressure to said nozzle orifice; and wherein said fixed center stem mounts an upwardly extending nozzle cleaning pin that is sized and shaped to pass through said nozzle orifice in said retracted position to thereby clean said orifice.

11. A sprinkler head comprising:

a first housing carrying a center stem having an inlet at an upstream end and a radially outwardly-facing outlet aperture at a downstream end;

a second housing supported within said first housing and enclosing a nozzle provided with a nozzle orifice and a pressure regulator in axially-aligned relationship defining a flowpath between said inlet and an orifice of said nozzle, said second housing normally biased to a retracted position but moveable to an extended position relative to said first housing and to said center stem, wherein a surface of said pressure regulator moves relative to said outlet aperture of said center stem to change the size of the flowpath through said outlet aperture as said second housing moves relative to said first housing to regulate pressure to said nozzle orifice, and wherein an inner annular surface of said nozzle engages an upper annular edge of said center stem to prevent backflow into said center stem when said second housing is in said retracted position.

12. A sprinkler head comprising:

a first outer housing adapted to attachment to a riser;

a second inner housing normally enclosed in a retracted position within said first outer housing and moveable to an extended operative position;

said second housing supporting a nozzle and a rotatable water-distribution plate downstream of said nozzle; said second housing further including first means for continuously regulating pressure of water delivered to said nozzle, second means for controlling speed of rotation of said water-distribution plate, third means for automatically cleaning said nozzle upon movement of said second housing to said retracted position; and an annular seal supported in said first outer housing sealingly engaging said second inner housing.

13. The sprinkler head of claim 12 wherein said second housing further includes fourth means for preventing backflow through said nozzle in said retracted position.

14. A sprinkler head comprising:

a first outer housing adapted to attachment to a riser;

a second inner housing normally enclosed in a retracted position within said first outer housing and moveable to an extended operative position;

said second housing supporting a nozzle and a rotatable water-distribution plate downstream of said nozzle; said second housing further including first means for continuously regulating pressure of water delivered to said nozzle, second means for controlling speed of rotation of said water-distribution plate, and third means for automatically cleaning said nozzle upon movement of said second housing to said retracted position; and wherein said first means includes a spring external to said second housing arranged to normally bias said second housing to said retracted position.

15. The sprinkler head of claim 12 including a cap removably attached to said first outer housing such that movement of said second inner housing to said extended position is prevented.

16. The sprinkler head of claim 12 wherein said water-distribution plate is formed with grooves configured to cause said water-distribution plate to rotate relative to said first outer housing and said second inner housing when a stream of water emitted from said nozzle orifice impinges on said grooves.

17. A sprinkler head comprising:

a first housing carrying a center stem having an inlet at an upstream end and an outlet at a downstream end;

a second housing supported within said first housing and enclosing a nozzle having a nozzle orifice downstream of said outlet;

said second housing normally biased to a retracted position but linearly displaceable to an extended position relative to said first housing and to said center stem by introduction of a supply of water under pressure;

a pin fixed to said center stem and extending upwardly through said nozzle orifice in said retracted position but spaced from said nozzle orifice when said second housing is in said extended position, such that said nozzle orifice is automatically cleaned upon movement of said second housing from said extended position to said retracted position.

18. The sprinkler head of claim 17 wherein said second housing supports a water-distribution plate downstream of said nozzle orifice, said water-distribution plate formed with grooves configured to cause said water-distribution plate to rotate relative to said first and second housings when a stream of water emitted from said nozzle orifice impinges on said grooves.

19. The sprinkler head of claim 18 and further comprising a brake housing supported on an upper portion of said second housing, with said water-distribution plate mounted on said brake housing, said brake housing rotatable along with said water-distribution plate, relative to said first and second housings.

20. The sprinkler head of claim 19 wherein said brake housing incorporates a viscous brake operatively connected to said water-distribution plate, said viscous brake comprising a rotatable element and non-rotatable element cooperating with a viscous fluid to slow rotation of said water-distribution plate.

21. The sprinkler head of claim 19 wherein said brake housing caries a shaft rotatable with said brake housing, said shaft carrying a first gear engaged with a second gear carried by said second housing, said shaft also carrying a rotor element located within a chamber at least partially filled with a viscous fluid such that rotation of said shaft and said first gear, along with rotation of said brake housing and water-distribution plate, are slowed by shearing of said viscous fluid between said rotor element and a wall of said chamber.

22. A sprinkler head comprising:

a first housing carrying a center stem having an inlet at an upstream end and an outlet at a downstream end;

a second housing supported within said first housing and enclosing a nozzle having a nozzle orifice downstream of said outlet;

said second housing normally biased to a refracted position but moveable to an extended position relative to said first housing and to said center stem;

a pin fixed to said center stem and extending upwardly through said nozzle orifice in said retracted position but spaced from said nozzle orifice when said second housing is in said extended position, such that said nozzle orifice is automatically cleaned upon movement of said second housing from said extended position to said retracted position, wherein said outlet of said center stem comprises a pair of teardrop-shaped apertures, and wherein said second housing also encloses a pressure regulator coaxial with and upstream of said nozzle, a radially inwardly facing, convexly curved surface of said pressure regulator cooperating with said teardrop-shaped apertures to regulate pressure to said nozzle orifice as said second housing moves relative to said center stem.

* * * * *